US009815587B2

(12) United States Patent
Matsuoka

(10) Patent No.: US 9,815,587 B2
(45) Date of Patent: Nov. 14, 2017

(54) FOLDING CONTAINER

(71) Applicant: DAIICHI OHMIYA CO., LTD., Osaka (JP)

(72) Inventor: Takamine Matsuoka, Osaka (JP)

(73) Assignee: DAIICHI OHMIYA CO., LTD., Osaka (JP)

( * ) Notice: Subject to any disclaimer, the term of this patent is extended or adjusted under 35 U.S.C. 154(b) by 7 days.

(21) Appl. No.: 14/402,021

(22) PCT Filed: Nov. 25, 2013

(86) PCT No.: PCT/JP2013/081594
§ 371 (c)(1),
(2) Date: Nov. 18, 2014

(87) PCT Pub. No.: WO2015/075830
PCT Pub. Date: May 28, 2015

(65) Prior Publication Data

US 2016/0272363 A1 Sep. 22, 2016

(51) Int. Cl.
*B65D 6/00* (2006.01)
*B65D 6/18* (2006.01)
(Continued)

(52) U.S. Cl.
CPC ..... *B65D 11/186* (2013.01); *B65D 11/10* (2013.01); *B65D 11/1833* (2013.01);
(Continued)

(58) Field of Classification Search
CPC ..... B65D 11/10; B65D 11/24; B65D 11/26; B65D 65/403; B65D 11/186; B65D 11/1833; B65D 11/18
(Continued)

(56) References Cited

U.S. PATENT DOCUMENTS 4,684,034 A * 8/1987 Ono ..... B65D 7/24 220/6
5,038,953 A * 8/1991 Radar ..... B65D 11/1826 220/6
(Continued)

FOREIGN PATENT DOCUMENTS

EP 1386848 A1 2/2004
JP 6-22226 U 3/1994
(Continued)

OTHER PUBLICATIONS

International Search Report and Written Opinion for PCT Patent App. No. PCT/JP2013/081594 (dated Mar. 4, 2014).

*Primary Examiner* — Fenn C Mathew
*Assistant Examiner* — Don M Anderson
(74) *Attorney, Agent, or Firm* — Cermak Nakajima & McGowan LLP; Tomoko Nakajima

(57) ABSTRACT

A long corrugated plastic folding container, having a folding structure in which a first side panel and latch side panel that oppose each other are provided from a floor panel, a first incision having the same height is provided in the first side panels, third incisions are provided thereabove, second incisions are provided therebelow, a second side panel is provided towards the front and rear edges of the floor panel, frames are attached to the upper end parts of the first side panels and second side panels, the first incisions of the first side panels fold inwards, and the second incisions and third incisions fold outwards, where the height dimension of the first side panel is greater than the short edge dimension, and, above the third incision serves as an upper short side panel, below the third incision and above the second incision.

6 Claims, 19 Drawing Sheets

(51) Int. Cl.
*B65D 65/40* (2006.01)
*B65D 6/38* (2006.01)
*B65D 6/34* (2006.01)

(52) U.S. Cl.
CPC ..... *B65D 11/24* (2013.01); *B65D 11/26* (2013.01); *B65D 65/403* (2013.01); *B65D 65/406* (2013.01); *B65D 2301/20* (2013.01)

(58) Field of Classification Search
USPC ..... 206/6
See application file for complete search history.

(56) References Cited

U.S. PATENT DOCUMENTS

| | | | | |
|---|---|---|---|---|
| 5,671,858 | A * | 9/1997 | Hsu | B65D 11/18 220/9.2 |
| 2004/0188506 | A1 | 9/2004 | Lane | |
| 2008/0035717 | A1* | 2/2008 | Turvey | B65D 11/186 229/117.02 |
| 2012/0248105 | A1* | 10/2012 | Leong | B65D 88/524 220/7 |
| 2015/0028028 | A1* | 1/2015 | Matsuoka | B65D 11/1893 220/7 |
| 2016/0368656 | A1* | 12/2016 | Green | B65D 11/1826 |

FOREIGN PATENT DOCUMENTS

| | | | |
|---|---|---|---|
| JP | 8-2524 | A | 1/1996 |
| JP | 9-48433 | A | 2/1997 |
| JP | 3098273 | U | 9/2003 |
| JP | 2007-112445 | A | 5/2007 |
| JP | 3164095 | U | 10/2010 |

* cited by examiner (a)

(b)

(c)

(a)
9b
9c
8b
B
8c
4f
4a
4
B
9
9a
8a
8A
4A
8
3B
3c
3
(b)
9b
9c
8b
B
8c
3c
3
9
9a
8a
8
3B
4a
4
8A
(c)
9c
8b
8e
8c
9b
9
9a
8a
8B (a)

(b)

(a)

(b)

FOLDING CONTAINER

This application is a national phase entry under 35 U.S.C. §371 of PCT Patent Application No. PCT/JP2013/081594, filed on Nov. 25, 2013, which is incorporated by reference.

TECHNICAL FIELD

The present invention relates to a folding container made from corrugated plastic, and particularly relates to a long folding container. In the present invention, the term "long folding container" refers to a container in which the height dimension is larger than the short edge dimension of the floor panel.

TECHNICAL BACKGROUND

Corrugated plastic containers that are returnable and have excellent break strength and sanitation properties have been proliferating in recent years. Corrugated plastic folding containers with added folding functionality are now being used for this type of corrugated plastic container in order to achieve improved transport and storage efficiency when not in use.

Corrugated plastic containers are used for storing a wide variety of goods with various forms, and thus containers with various shapes and sizes are used. One form of container is the long folding container. Long folding containers are larger in the height dimension than in the width dimension, and a folding structure is typically added to the opposing side panels, because the width becomes greater than the width of the floor panel when the side panels are knocked down as-is, making the container extremely unwieldy.

Folding reusable shipping cartons, which are an example of this type of conventional folding container, are composed of side panels, a floor panel, a frame that is provided on the upper part of the side panels, and a gate panel that is rotatably provided on the frame, and folding reusable shipping cartons are well known in which the support points of the hinges that link the frame with the side panels and the floor panel with the side panels are provided at different heights (e.g., refer to patent document 1).

Additionally, although not considered to be long folding containers because their height dimension is smaller than the width dimension, folding containers are well known that have a box-shaped upright configuration in which the panels are formed from non-foamed plastic panel or corrugated plastic having a bonded wave-form plastic core. Left and right side panels that are connected via half-cut hinges to the four edges of a square floor panel along with front and rear latch panels are formed, half-cut hinges are provided midway along the height direction in the left and right side panels, and the front and rear side panels are attached to the front and rear latch panels using face fasteners (e.g., refer to patent document 2).

PRIOR ARTS LIST

Patent Document 1: Japanese Laid-Open Utility Model Publication No. 6-22226

Patent Document 2: Japanese Utility Model Registration No. 3098273

SUMMARY OF THE INVENTION

Problems to be Solved by the Invention

The high corrugated plastic folding container disclosed in patent document 1 is formed so as to be left-right asymmetrical with the hinge positions of the left and right side panels being shifted so that the bulky side panels can be folded to produce a low profile. As a result of this configuration, the bulky side panels will superimpose, and folding will not be possible, unless the hinges are provided with the hinge locations of the folding side panels offset on left and right, and the structure will not fold unless folding is carried out based on a previous decision to fold the panels to the left or right. The container thus has the disadvantage of being extremely laborious in regard to assembly and folding.

In addition, in order to realize the structure described above, side panels must be produced in which the hinge positions of the left and right side panels are different on the left and right, and a corresponding increase in time has thus been required for their manufacture.

In addition, among the folding containers described above, those containers that are folded in multiple layers by providing multiple hinges on the side panels in order to decrease bulk have the disadvantage of requiring additional labor.

The folding container of patent document 2, as described above, basically has a height dimension that is smaller than the width dimension and therefore is not a long folding container. On the other hand, the container has a structure in which half-cut hinges are provided mid-way in the height direction on the left and right side panels.

However, with this structure, it is necessary to maintain the same height for the left and right side panels that have been folded up in order to preserve a condition whereby it is possible to maintain the folded state, and the container can only be assembled with dimensions that are in a range whereby interference does not occur in the folded state (specifically, with the left and right side walls having height dimensions that are no greater than the width dimensions).

For this reason, when the height of the opposing left and right side panels is additionally increased using this structure in the attempt to produce a long folding container configuration, then the left and right side panels will interfere with each other, and the upper part will float up in the folded state, making it impossible to maintain a stable folded condition. For this reason, in the end, the left and right side walls must be set at heights that are no greater than the width dimension, and a long folding container cannot be achieved using the folding container structure of patent document 2.

In addition, with the folding container of patent document 2, a carton is formed by providing half-cut incisions in the front and rear latch panels and the left and right side panels and folding the incisions. There is thus the disadvantage that the box strength is poor and deformations such as bottom-sagging (bending of the floor) arise. In terms of uses for corrugated plastic folding containers, it is preferable for the folding container itself to resist deformation and bottom-sagging during use and during transport in a folded state.

In addition, with the folding container of patent document 2, a box is formed without welding the two ends of the latch panels, and there is thus the chance that dirt, dust, or insects will enter, unless the four corners of the folding container are completely sealed.

In addition, as described above, the long folding container of the present invention is understood to be a folding container in which the height dimension is larger than the short edge dimension of the floor panel. Even with these high folding containers, however, structure are preferred that have higher ratios of the height dimension with respect to the short edge dimension of the floor panel.

The present invention was developed in light of the above state of affairs, and an object of the invention is to provide a long folding container made from corrugated plastic that can be folded from the left or right, that can be easily assembled, and which resists distortion.

In addition to resolving the issues described above, the present invention offers a long folding container whereby the strength of the box can be ensured as means for resolving an issue.

In addition to resolving the issues described above, the present invention offers a long folding container having a high level of air-tightness, allowing the danger of ingress of dirt, dust, or insects to be greatly decreased.

Means to Solve the Problems

As a means for resolving the problems, the present invention provides a long folding container made from corrugated plastic having a folding structure wherein a first side panel is provided opposite to the left and right edges of a floor panel, a latch side panel is provided opposite to the front and back edges of the floor panel, a first incision is provided in the left and right first side panels at the same height, a third incision is provided in an upper part of each first side panel, a second incision is provided in a lower part of the first side panel, a column member is provided at both lateral end parts of each first side panel, opposing second side panels are provided at the front and rear edges of the floor panel, frames are attached to upper end parts of each first side panel and second side panel, and, for each opposing first side panel, the first incision folds in, and the second incision and third incision fold out, said long folding container made from corrugated plastic characterized in that: the height dimension of the first side panel is larger than the short edge dimension of the floor panel; with each first side panel, above the third incision serves as an upper short side panel, below the third incision and above the second incision serves as a middle panel, and below the second incision serves as a lower short side panel; the opposing first incisions, second incisions, and third incisions are made to have the same respective heights; the internal space of the folding container comprises a first internal space that is circumscribed by the floor panel, the lower short side panel, and the respective latch side panels; a gap is provided between the first side panel and the short side panel that opposes it in the folded state; additionally, each middle side panel, when in a folded state, can be stored in an inner space containing the first inner space; and in the folded structure, both the left and right middle side panels can fold while being superimposed on each other when brought upwards.

As a means for resolving the problems, the present invention, presupposing the configuration described above, provides a corrugated plastic long folding container according to claim 1, characterized in that, taking the height dimension of the center side panel in each first side panel as H1, taking the height dimension of each folding side panel configured so that the middle side panels can fold up as H2, taking the left and right width dimensions of the floor panel as L, and taking the gap dimension between the first side panel and the opposing short side panel in the folded state as X, then, for both the left and right middle side panels, the maximum value of H1 is $2\times(L-X)$, and $20\ mm \leq X < H2$.

As a means for resolving the problems, the present invention, presupposing the configuration of any of the inventions described above, provides a corrugated plastic long folding container, characterized in that the height of the latch side panel is greater than the height of the lower short side panel.

As a means for resolving the problems, the present invention, presupposing the configuration of any of the inventions described above, provides a corrugated plastic long folding container, characterized in that the second side panel has a fifth incision that divides the second folding side panel and third folding side panel, and each front and rear folding panel that superimpose so as to allow abutting or approaching of the inner faces of the second folding side panels and the inner faces of the third folding side panels that connect therewith can be disposed in the inner space above the middle side panels.

As a means for resolving the problems, the present invention, presupposing the configuration of any of the inventions described above, provides a corrugated plastic long folding container, characterized in that the internal space of the folding container in a folded state contains a second internal space that is bounded by each upper short side panel and each latch side panel.

As a means for resolving the problems, the present invention, presupposing the configuration of any of the inventions described above, provides a corrugated plastic long folding container, characterized in that a face panel part is formed on both end parts of the first incision of the first side panel by making incisions encompassing three peripheral sides, leaving the outer face.

As a means for resolving the problems, the present invention, presupposing the configuration of any of the inventions described above, provides a corrugated plastic long folding container, characterized in that each column member is attached to an end face part of the first side panel at a location that is not near the face panel part, and the face panel protrusion part is extended so as to protrude from the end face part of the face panel part.

As a means for resolving the problems, the present invention, presupposing the configuration of any of the inventions described above, provides a corrugated plastic long folding container, characterized in that a folding part that protrudes from the end face part is provided in the lower short side panel; a first inclined face is formed at a location on the bending piece that will be towards the floor panel; an end face that connects with the first inclined face is used as a first vertical face; for both ends of the latch side panel, a second vertical face is formed wherein the width of the latch side panel is decreased by the width of the bending pieces, and a second inclined face is formed in the lower end of the second vertical face; the upright structure of the lower short side panels and latch side panels with respect to the floor panel is a structure that is fixed by welding and does not involve half-cuts; and the first inclined surface and second inclined surface, and the first vertical surface and second vertical surface, are fixed to each other by welding.

Advantageous Effects of the Invention

In accordance with the invention of claim 1, a container is provided having a folding structure wherein a first side panel is provided opposite to the left and right edges of a floor panel, a latch side panel is provided opposite to the front and back edges of the floor panel, a first incision is provided in the left and right first side panels at the same height, a third incision is provided in an upper part of each first side panel, a second incision is provided in a lower part of the first side panel, a column member is provided at both lateral end parts of each first side panel, opposing second side panels are provided at the front and rear edges of the floor panel, frames are attached to upper end parts of each first side panel and second side panel, and, for each opposing first side panel, the first incision folds in, and the second incision and third incision fold out, said long folding container made from corrugated plastic characterized in that: the height dimension of the first side panel is larger than the short edge dimension of the floor panel; with each first side panel, above the third incision serves as an upper short side panel, below the third incision and above the second incision serves as a middle panel, and below the second incision serves as a lower short side panel; the opposing first incisions, second incisions, and third incisions are made to have the same respective heights; the internal space of the folding container comprises a first internal space that is circumscribed by the floor panel, the lower short side panel, and the respective latch side panels; a gap is provided between the first side panel and the short side panel that opposes it in the folded state; additionally, each middle side panel, when in a folded state, can be stored in an inner space containing the first inner space; and in the folded structure, both the left and right middle side panels can fold while being superimposed on each other when brought upwards. As a result, the respective middle side panels in a folded state can be moved towards the first inner space formed underneath while in a folded state, without interfering with the facing latch side panel, and, in addition, by moving the respective middle side panels in a folded state towards the first inner space, the upwards bulk can be greatly decreased, and folding of the middle side panels with the panels superimposed on each other is possible with either of the middle side panels on top.

In addition, a container is provided which is characterized in that, in addition to the configuration of the invention of claim 1, taking the height dimension of the center side panel in each first side panel as H1, taking the height dimension of each folding side panel configured so that the middle side panels can fold up as H2, taking the left and right width dimensions of the floor panel as L, and taking the gap dimension between the first side panel and the opposing short side panel in the folded state as X, then, for both the left and right middle side panels, the maximum value of H1 is $2\times(L-X)$, and $20\ mm \leq X < H2$. As a result, the gap dimension X is a dimension that can ensure superposition of the opposing folded side panels, thus ensuring smooth folding operations. The middle side panel also can be provided with a height (H1) that is actually nearly twice the lateral width dimension.

In addition, in accordance with the invention according to claim 2, a container is provided, which is characterized in that the height of the latch side panel is greater than the height of the lower short side panel. As a result, in the folded state, the latch side panels abut the lower ends of the frames even when the lower short side panels do not abut the frames, and flatness during folding is preserved as a result of the abutment, allowing a decrease in distortion. Moreover, sufficient internal space for retaining or disposing the folding side panels can be ensured in accordance with the height of the latch side panels, and a gap will not be produced over a region extending to the frame, thereby inhibiting ingress of foreign matter.

In addition, in accordance with claim 3, presupposing the configuration of any of the inventions described above, a container is provided which is characterized in that the internal space of the folding container in a folded state contains a second internal space that is bounded by each upper short side panel and each latch side panel. As a result, merits of the present invention can be realized whereby the middle side panels can be superimposed on each other and folded up with either of the middle side panels upwards when sufficient space cannot be ensured towards the first inner space with the respective middle side panels in a folded state by supplementing the inner space and ensuring a retaining space that contains the first inner space and a second inner space.

In addition, presupposing the configuration of any of the inventions described above, a container is provided which is characterized in that the second side panel has a fifth incision that divides the second folding side panel and third folding side panel, and each front and rear folding side panel, that superimpose so as to allow abutting or approaching of the inner faces of the second folding side panels and the inner faces of the third folding side panels that connect therewith, can be disposed in the inner space at a position above the middle side panels. As a result, through manifesting any of the actions and effects of the inventions described above, the second side panels are disposed in the inner space, and thus a folding container form can be ensured which prevents interference with the middle side panels in the first side panels.

In addition, in accordance with the invention of claim 4, presupposing the configuration of any of the inventions described above, a container is provided wherein a face panel part is formed on both end parts of the first incision of the first side panel by making incisions encompassing three peripheral sides, leaving the outer face. Through manifesting any of the actions and effects of the invention described above, the first incisions (hinge parts) can be reinforced, and the durability of the first incisions can be improved.

In addition, in accordance with the invention of claim 5, presupposing the configuration of the invention according to claim 4, a container is provided wherein each column member is attached to an end face part of the first side panel at a location that is not near the face panel part, and the face panel protrusion part is extended so as to protrude from the end face part of the face panel part. As a result, the column members can be easily positioned at the end faces of the middle side panels, and the column members can be positioned and fixed accurately at four locations. Lateral distortion of the column members when folding the column members is thereby eliminated, allowing smooth folding of the folding container.

In addition, in accordance with the invention of claim 6, presupposing the configuration of any of the inventions described above, a container is offered wherein a folding part that protrudes from the end face part is provided in the lower short side panel; a first inclined face is formed at a location on the bending piece that will be towards the floor panel; an end face that connects with the first inclined face is used as a first vertical face; for both ends of the latch side panel, a second vertical face is formed wherein the width of the latch side panel is decreased by the width of the bending pieces, and a second inclined face is formed in the lower end of the second vertical face; the upright structure of the lower short side panels and latch side panels with respect to the floor panel is a structure that is fixed by welding and does not involve half-cuts; and the first inclined surface and second inclined surface, and the first vertical surface and second vertical surface, are fixed to each other by welding. As a result, through manifesting any of the actions and effects of the present invention described above, in particular, the upright structure of the lower short side panel and the latch side panel with respect to the bottom panel is produced as a welded fixed structure, without involving half-cuts, and the first vertical face and second vertical face are welded and fixed, thereby ensuring strength at the four corners towards the floor part and inhibiting deformation such as bottom sagging when holding heavy objects.

In addition, because the first inclined faces and second inclined faces, and the first vertical faces and second vertical faces, are fixed by welding, no gaps are formed whereby dirt, dust, or insects can enter from the surrounding floor surface, thereby greatly reducing the chance of ingress of such materials.

BRIEF DESCRIPTION OF THE DRAWINGS

FIG. 12*a* is a right side view midway during folding in which the first side panels are overlapped to the left and right, and FIG. 12*b* is a right side view that portrays the folded state in which the middle side panels of the first side panels are superimposed.

FIG. 13*a* is a right side view midway during folding with the first side panels overlapping to the left and right, and FIG. 13*b* is a right side view that portrays the folded state in which the middle side panels of the first side panels are superimposed.

DESCRIPTION OF THE EMBODIMENTS

Preferred embodiments of the long corrugated plastic folding container 1 of the present invention are described in detail below with reference to the drawings.

EXAMPLE 1

Figure 1:
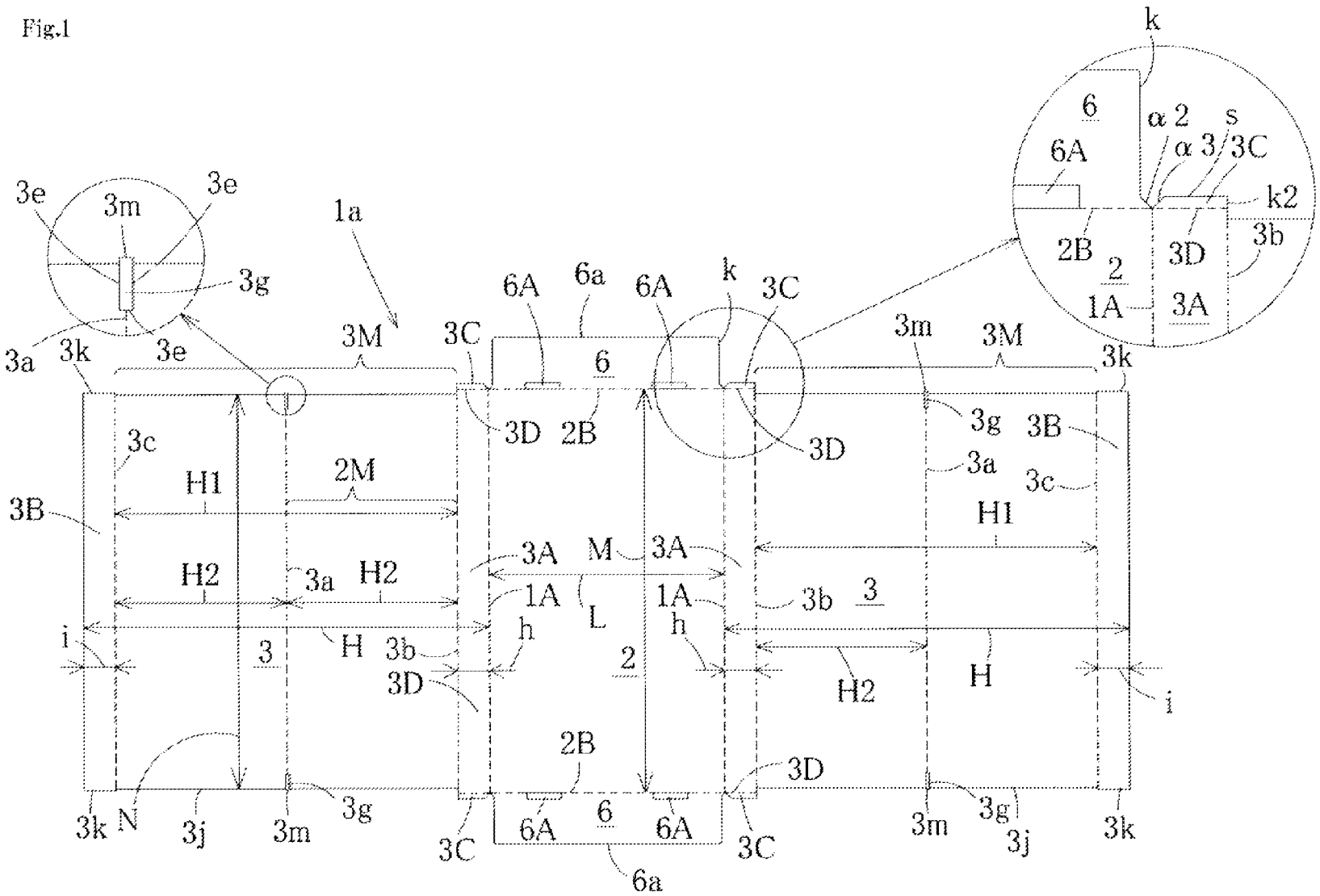
FIG. 1 is an exploded plan view of the folding container main body with a long floor panel of Example 1 of the present invention, and a partially enlarged view thereof.
Figure 2:
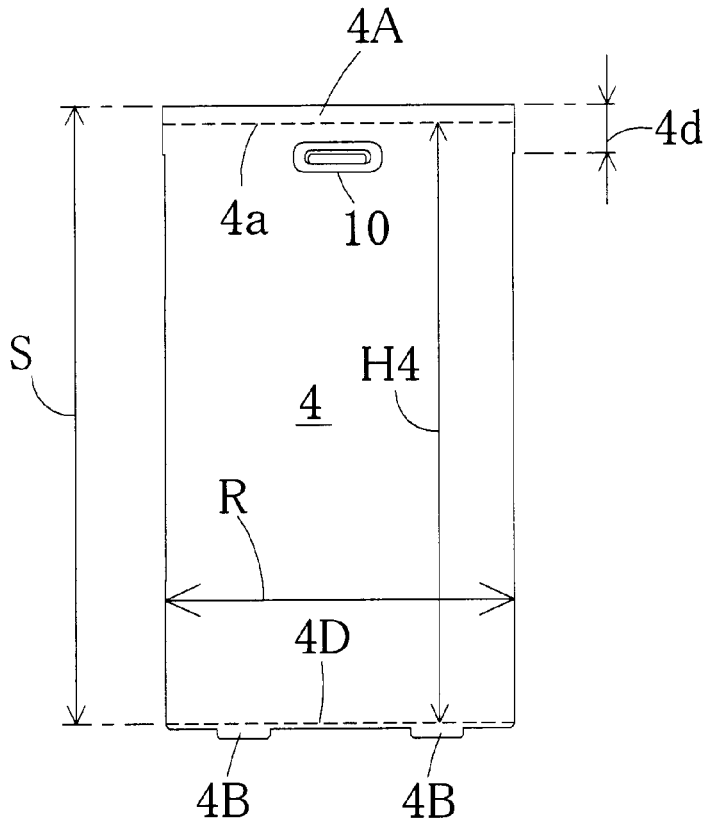
FIG. 2 is a front view of the second side panel of the folding container of the Example 1 of the present invention.
Figure 3:
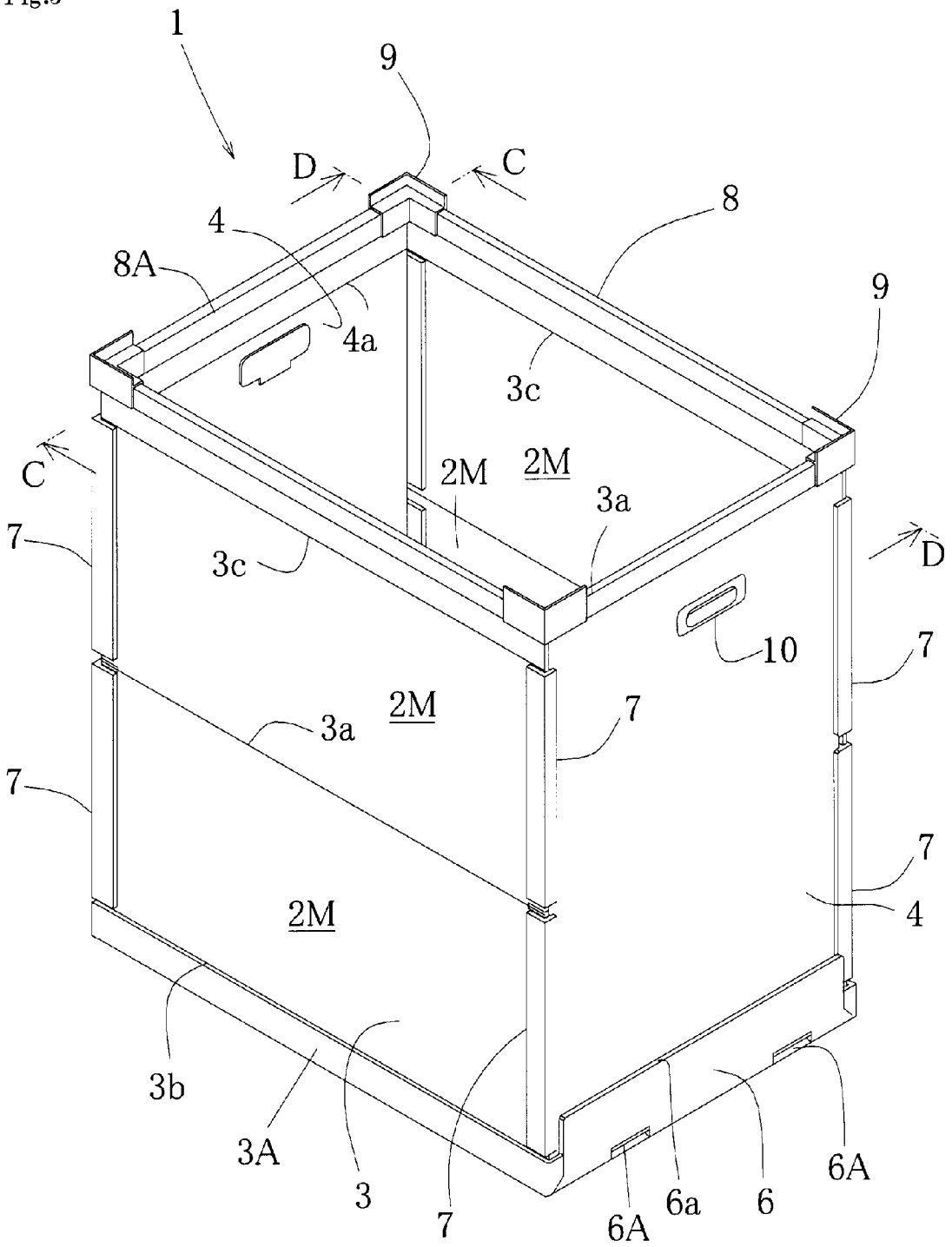
FIG. 3 is an oblique view of the assembled state of the folding container of Example 1 of the present invention.

FIG. 1 shows the folding container main body 1*a* that constitutes the folding container 1 of Example 1 of the present invention. FIG. 2 shows a second side panel 4. In addition, FIG. 3 is a total view of the folding container 1 of Example 1. FIGS. 4 to 15 show various configurations and the like related to Example 1.

In the descriptions below, the downward direction in FIG. 1 is taken to be frontwards, the upwards direction is taken to be rearwards. With the side panels (first side panels 3, latch side panels 6), the upwards and downwards directions of each during assembly are taken as the vertical direction.

The folding container 1 of Example 1 is a long corrugated plastic folding container 1 in which the floor panel 2 is a rectangle as seen from a plan view. The container is constituted, primarily, by the folding container main body 1*a* shown in FIG. 1 and the second side panels 4 shown in FIG. 2. Additionally, column members 7, frames 8, 8A, and upper corner members 9 are used in order to maintain the strength of the side panels of the folding container 1.

The corrugated plastic panels that are used in Example 1 for the folding container main body 1*a* and the second side panels 4 are all hollow synthetic resin panels that do not possess directional properties.

Figure 15:
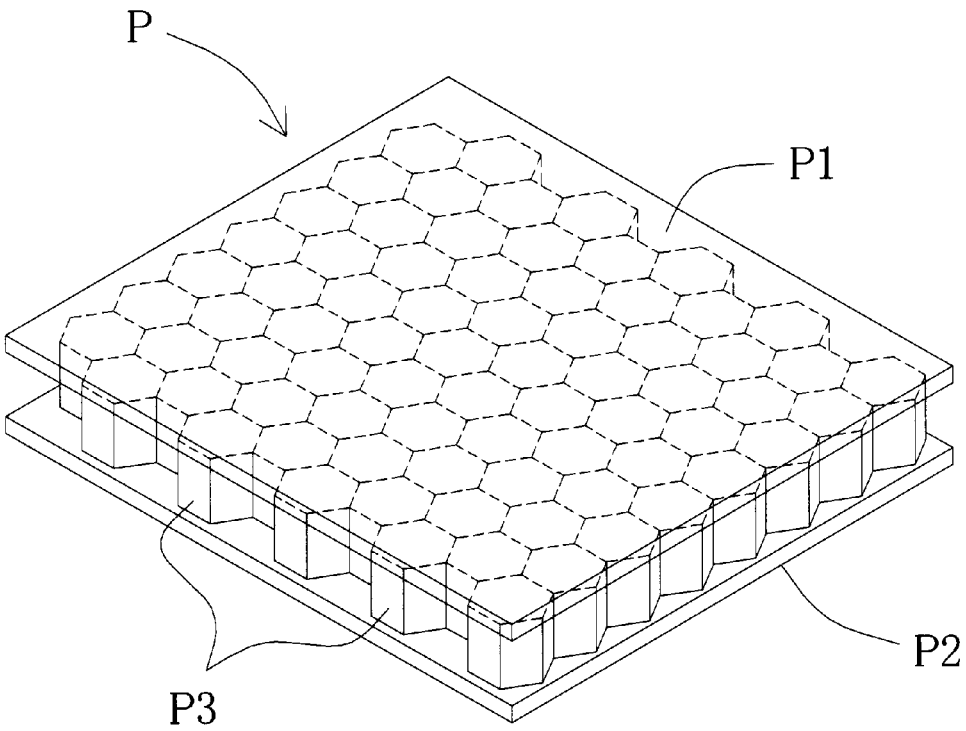
FIG. 15 is an enlarged perspective view that portrays an example of a corrugated plastic sheet.

An example of a hollow synthetic resin that does not have directional properties is a corrugated plastic panel P, (product name "Teccell" (a registered trademark), manufactured by Gifu Plastic Industry Co., Ltd.). The corrugated plastic panel P, as shown in FIG. 15, has a configuration comprising an inner face panel P1 and an outer face panel P2, which are parallel face panels that are connected by a core material P3 having a honeycomb structure that is provided in the gap between the face panels.

The folding container main body 1*a* is constituted as a continuous integral body comprising a floor panel 2, respective latch side panels 6 that are provided to the front and rear of the floor panel 2, with respective folding lines 2B interposed, and respective first side panels 3 that are disposed to the left and right of the floor panel 2, with folding lines 1A interposed. In the assembled state, the latch side panels 6 and the first side panels 3 face each other.

The floor panel 2, as shown in FIG. 1, is a rectangle as seen from a plan view, with the width of the floor panel 2 being denoted by L and the center length being denoted by M.

The first side panel 3 has a lower short side panel 3A that is adjacent to the floor panel 2, with a folding line 1A interposed, a middle side panel 3M that is connected to the lower short side panel 3A, with a second incision 3*b* interposed, and an upper short side panel 3B that is connected to the middle side panel 3M, with a third incision 3*c* interposed.

As shown in FIG. 1, the height of the first side panel 3 is denoted by H, and the height of the middle side panel 3M is denoted by H1.

The middle side panel 3M has a first incision 3*a* made mid-way along the height direction of the middle side panel 3M. The upper and lower portion of the middle side panel 3M that are partitioned by the first incision 3*a* is each referred to as a folding side panel 2M. The heights of the fold-up side panels 2M are both denoted by H2. In this embodiment each of the folding side panels 2M interposed by the first incision 3*a* is formed with the same height dimension.

At both ends of the first incision 3*a* of the first side panel 3 is provided a face panel part 3*g* by forming incisions 3*e*, 3*e*, 3*e* in three circumferential directions excluding the direction towards the end part and leaving the inside panel and outside panel faces of the first side panel 3.

The face panel part 3*g* in this example has a face panel protrusion part 3*m* that is formed on the end towards the end part.

A bending piece 3C is provided via a folding line 3D on both ends of the lower short side panel 3A. As shown in the partial enlarged view (diagram to the right) in FIG. 1, a first inclined face α3 is formed on the folding part 3C on the side towards the latch side panel, and the end face that connects to the first inclined face α3 is referred to as first vertical face s, whereas the face that is perpendicular to the first vertical face s is referred to as the first horizontal face k2.

A protrusion end part 3*k* is formed at both ends of the upper short side panel 3B. The height from the third incision 3*c* to the upper end is referred to as height i of the upper short side face.

As described above, the latch side panel 6 is provided via a folding line 2B at the front and rear of the floor panel 2. An engaging hole 6A is provided at two locations adjacent to the folding line 2B in the latch side panel 6.

Additionally, a configuration is produced in which a second vertical face k and an inclined face α2 are connected from near the two ends of the folding line 2B and are thus formed at the two ends of the respective latch side panels 6. In Example 1, the height of the latch side panel 6 is greater (higher) than the height of the lower short side panel 3A.

The second side panels 4 in Example 1, along with the latch panels 6 of the folding container main body 1*a* constitute the side surfaces to the front and rear of the folding container 1. An upper part piece 4A is provided via a fourth incision 4*a* in an upper part of the second side panel 4, and a folding line 4D is provided in a lower part of the second side panel. Protruding end parts with height 4*d* are provided at both ends of the upper part. Additionally, a configuration is produced in which engaging pieces 4B protrude at two locations at the lower ends of the second side panels 4. The height of the second side panel from the folding line 4D to the upper part piece 4A is denoted by S.

Additionally, each incision (first incision 3*a*, second incision 3*b*, third incision 3*c*, fourth incision 4*a*) that is used in folding and assembling the folding container is configured so as to cut only the outer face or the inner face, along with the core material therebetween. In Example 1, the first incision 3*a* is made by cutting the inner face panel and the core material, leaving the outer face panel, and the second incision 3*b*, the third incision 3*c*, and the fourth incision 4*a* are made by cutting the outer face panel and the core material, leaving the inner face panel.

Figure 7:
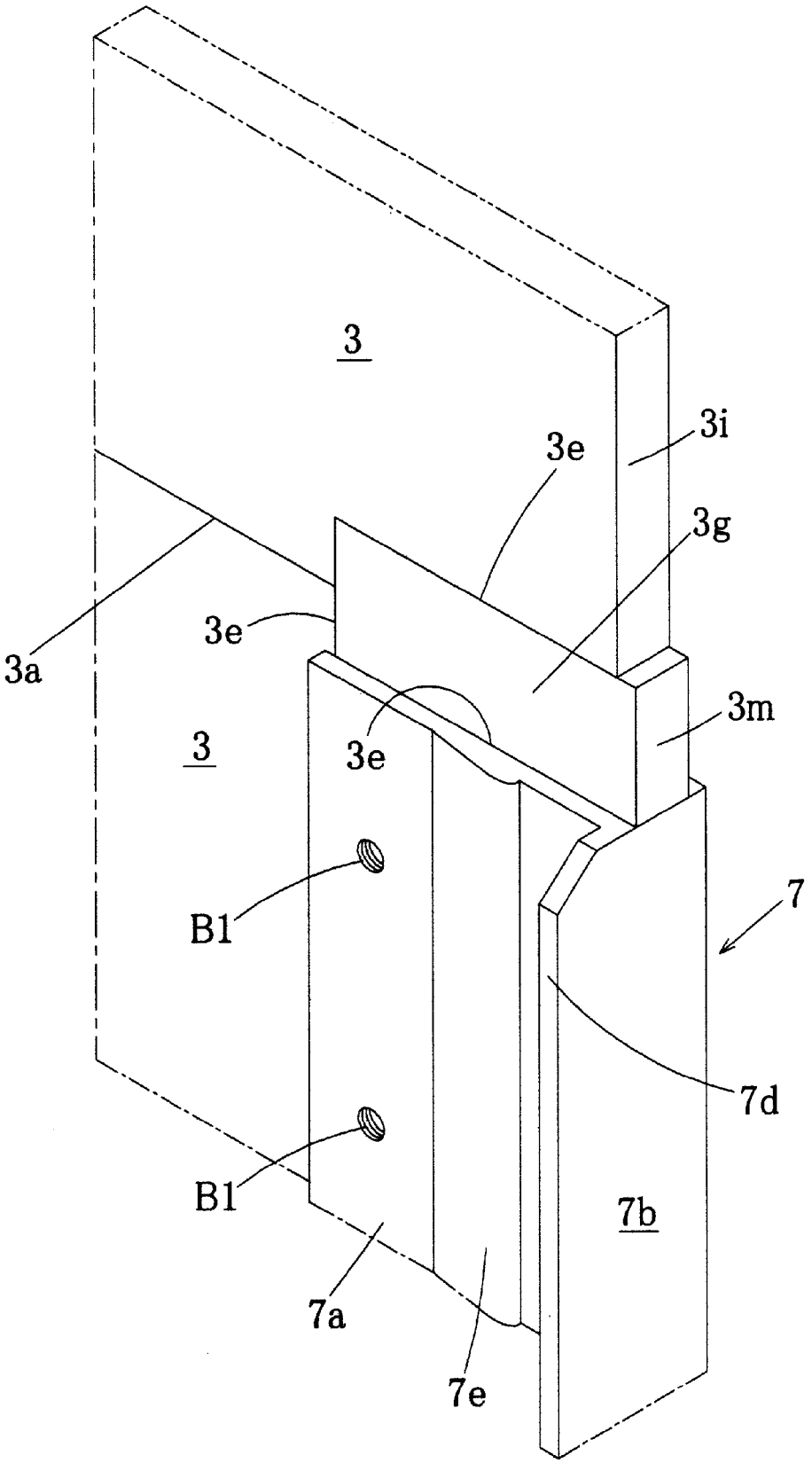
FIG. 7 is an explanatory partial enlarged view showing a condition in which a column member is attached while being positioned on a surface panel part that protrudes slightly from a first side panel in Example 1 of the present invention.
Figure 8:
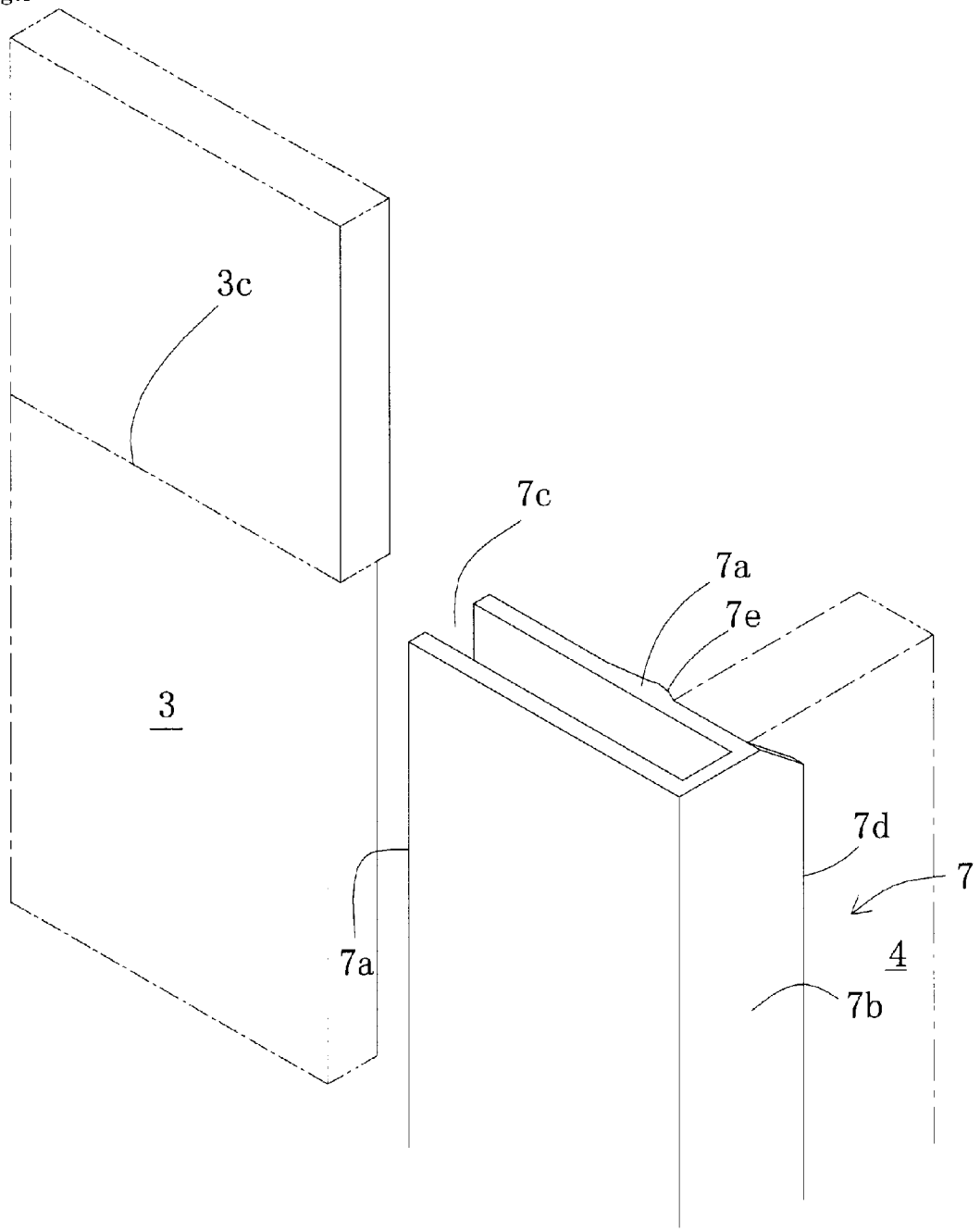
FIG. 8 is an explanatory enlarged perspective view, with parts omitted of the folding container of Example 1 of the present invention, prior to attachment of the column member to the face panel member of FIG. 7.
Figure 9:
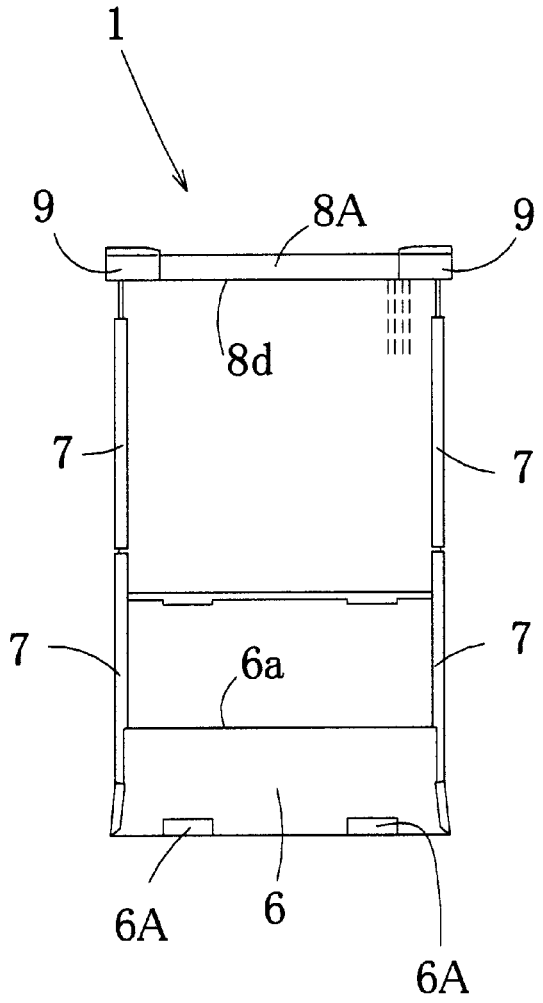
FIG. 9 is a side view showing the folded condition of the second side panel in Example 1 of the present invention showing a condition in which the second side panel incisions have been folded inward and the second side panels have been lifted upwards.

The column member 7 in Example 1, as shown in FIGS. 3, 7, 8, etc., is formed from synthetic resin and has a roughly open-ended cross sectional configuration, with an abutting piece 7*b* and two sandwiching pieces 7*a* having a gap 7*c*, the sandwiching pieces 7*a* being on one side and a stopper 7*e* being on the other side that is connected thereto. In addition, an abutting piece 7*d* is provided, slightly extending, on one end of the linking piece 7*b*.(*1)

Figure 6:
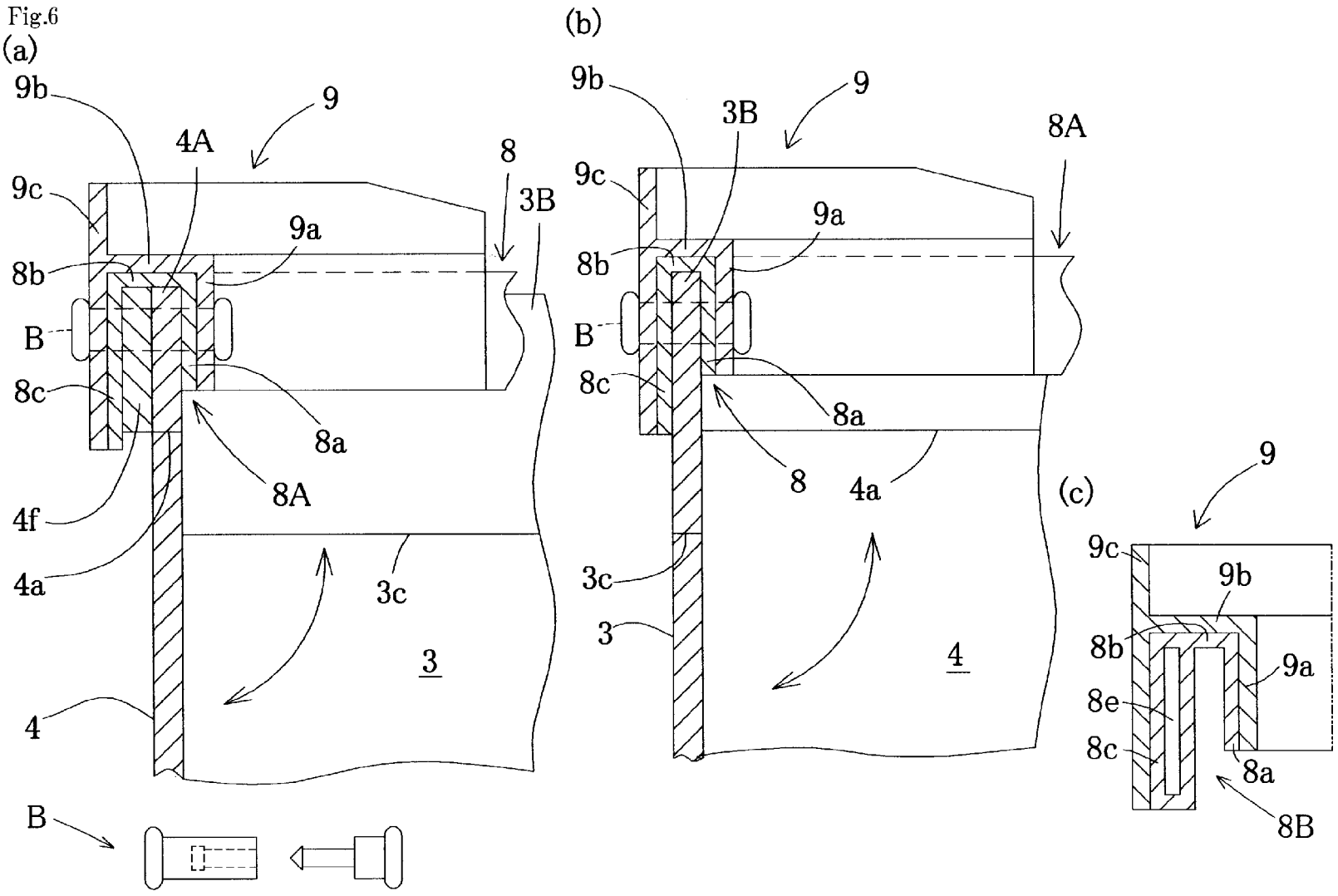
FIG. 6 is a diagram of the folding container of FIG. 3 pertaining to Example 1 of the present invention, wherein 6*a* is an enlarged C-C cross-sectional view, with parts omitted, 6*b* an enlarged D-D cross-sectional view, with parts omitted, and 6*c* is an enlarged cross-sectional view, with parts omitted, of the frame of another example.

For the frame in Example 1, as shown in FIGS. 3, 6(*a*), 6(*b*), etc., two types of frame 8 and 8A having different width dimensions are used, with frame 8 being attached to the upper short side panel 3B of the first side panel 3 (refer to FIG. 6(*b*)) and frame 8A being attached to the upper part piece 4A of the second side panel (refer to FIG. 6(*a*)).

Both frame 8 and 8A have shapes that comprise a roughly open-ended cross section in which an inner piece 8*b* hangs down from one end of an upper end piece 8*a*, and an outer piece 8*c* hangs down from the other end, running parallel with respect to each other.

In addition, the face panel part 3*g* ensures the mechanical strength of each incision, thus preventing breakage occurring along with opening closing movements of the incisions, and allowing improvement in the durability of the folding container 1.

Additionally, the face panel part 3*g* has a face panel protrusion 3*m* corresponding to the thickness of the constituent panel of the column member, which protrudes externally from the end face edge 3*j* on the face panel part 3*g*.

Figure 5:
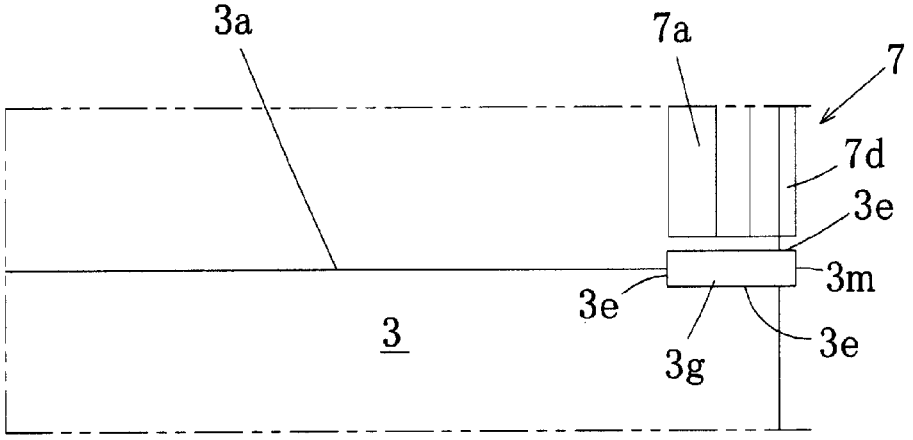
FIG. 5*a* is an explanatory partial enlarged view, showing the face panel part having a face panel protrusion in Example 1 of the present invention.
FIG. 5*b* is an explanatory partial enlarged view of the face panel part of another embodiment in which the incision end face of the first side panel and the end face part of the face panel part are the same.
FIG. 5*c* is an explanatory partial enlarged view showing a configuration in which face panel parts 3*h* are additionally formed whose four edges are encompassed by incisions 3*e* mid-way along the first incision 3*a* in the configuration of (*a*).
Figure 5:
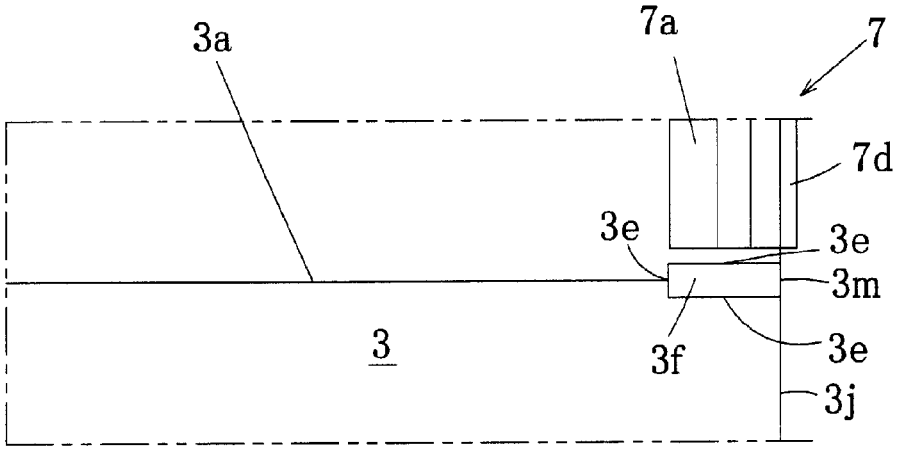
Figure 5:
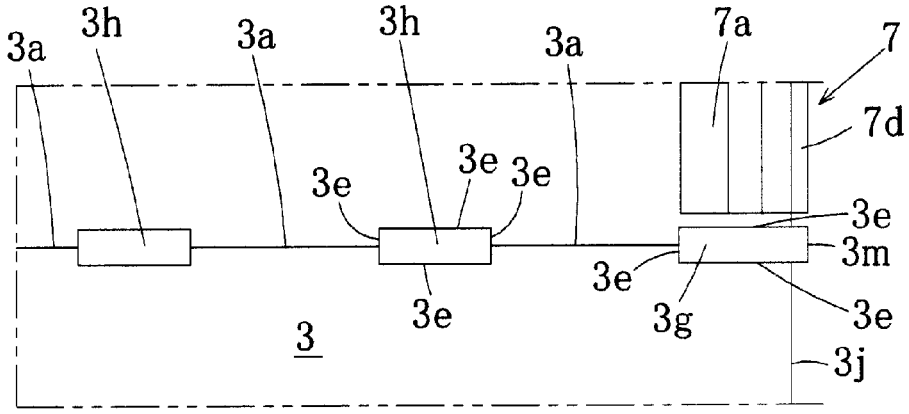

In addition to the effect of improving the durability of the folding container 1 due to the face panel parts described above by attaching the column members 7 vertically to the first side panels 3, running along so that the ends of the column members 7 abut the face panel protrusion parts 3*m*, because the upper and lower attachment positions of the column members can be determined accurately at four locations, the end faces of the column members 7 and the face panel protrusion parts 3*m* are roughly in the same plane, and so when folding the column members, lateral warping of the column members will be eliminated, and an effect will be obtained whereby folding of the box can be smoothly performed (refer to FIGS. 5(*a*) and 5(*c*)).

In addition, the various folding lines (creases 1A, 2B, 3D, 4D) used for forming the basic structure of the folding container all are formed, not by incisions, but by pressing a heating contact (bar) that has been heated to a prescribed temperature (e.g., about 250° C. to 300° C.) at the locations where the folding lines are to be formed.

In Example 1, a configuration is used in which a folding line is not formed per se, but rather a heated contact is pressed at the location where the folding line is to be formed, and the material is folded in this state, causing melting and solidification.

As shown below, a long folding container is constituted using the folding container main body 1*a* and the second side panels 4 in Example 1 described above.

Column members 7 are attached at both ends of the respective folding side panels 2M of the container main body 1*a*.

Attachment of the column members 7, as shown in FIG. 8, involves inserting the end part of the first side panel 3 in FIG. 7 into the gap 7*c* of the column member 7, then depressing the first side panel 3 and column member 7 by a prescribed amount with a prescribed heating contact element, thus fixing the first side panel 3 to the sandwiching pieces 7*a* of the column member 7 by ultrasound welding. In this example, an ultrasound welded part B1 is formed.

After attaching the column member to the middle side panel 3M, a heated bar at a prescribed temperature is made to impinge upon and fuse the folding line 2B serving as the border between the floor panel 2 and the latch side panel 6 and the folding line 3D that is connected therewith and serves as the boundary between the lower short side panel 3A and the bending piece. With the folding line 2B and the folding line 3D maintained in a melted state, the latch side panel 6 and the bending piece 3C are folded inwards. As a result of this folding, the latch side panel 6 is fixed to the floor panel 2 in a roughly vertically upright state. The bending piece 3C is similarly fixed to the short side panel 3A in a roughly vertically upright state.

Next, the folding line 1A that serves as a boundary between the floor panel 2 and the lower short side panel 3A, the second vertical face k and the second inclined surface α2 of the latch side panels 6 that are each in an upright state, and the first perpendicular face s and the first inclined face α3 of the bending piece 3C are melted by applying the heating bar at a prescribed temperature.

Next, while maintaining the melted states, the lower short side panels 3A are fixed by bending them inward, the first inclined face α3 and the second inclined face α2 of the latch side panels 6 are fixed, and the second vertical face k and the first vertical face s are fixed.

Figure 4:
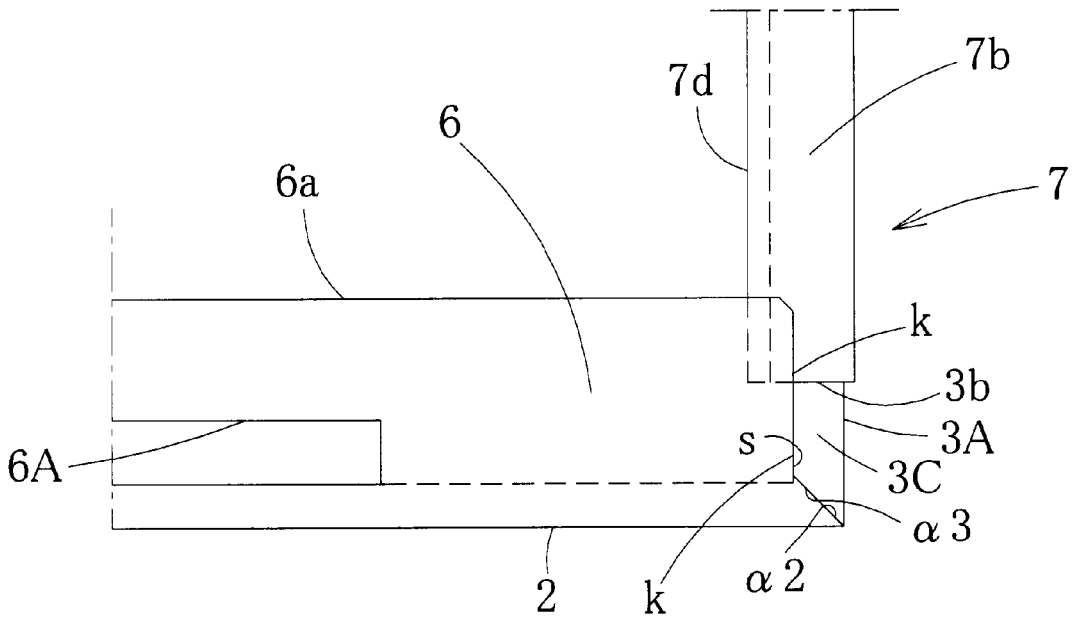
FIG. 4 is an explanatory enlarged view, with parts omitted, showing the latch side panel and the lower short side panel welded portion with the folded container in an assembled state in Example 1 of the present invention

As a result, the four corners of the floor part of the folding container 1 can be completely sealed (refer to FIG. 4). At this point, the height of the latch side panel 6 is higher than the height of the lower short side panel 3A, and so all of the first vertical face s of the bending piece 3C is fused and fixed.

Next, the heating bar at a prescribed temperature is made to impinge on folding lines 4D of each of the second side panels 4, the respective engaging pieces 4B are bent outwards, and the respective latching pieces 4B of the second side panels 4 engage with the respective engaging holes 6A of the latch side panels 6. (*2)

Next, the frames 8 are attached to upper end parts of the first side panels 3. In addition, a covering panel 4F is made to abut the outside of the upper part piece 4A of the second side panel 4, and the frame 8A is made to cover the upper end of the upper part piece 4A. Both end parts of the four corners of the frames 8, 8A are supported perpendicularly by the upper corner members 9 and are fixed with a synthetic resin rivet B so that they serve as male and female counterparts that can engage with each other.

As a result of this configuration, as shown in FIG. 6(*b*), in the first side panel 3, the inside faces of the inner piece 8*a*, the upper end piece 8*b*, and the outer piece 8*c* abut the upper short side panel 3B. Moreover, with the second side panel 4, as shown in FIG. 6(*a*), the inside faces of the inner piece 8*a*, the upper end piece 8*b*, and the outer piece 8*c* abut the upper end part of the upper part piece 4A and the covering panel 4*f* that abuts it.

With both the frame 8 and 8A, the upper end piece 8*b* and the upper end piece 9*b* of the upper corner member 9 abut. As a result of the above configuration, the side panels are supported by the frames 8, 8A, regardless of repetition of assembly and folding of the folding container, and thus the container can be assembled while inhibiting distortion, and the folded state always can be uniformly maintained.

In Example 1, as shown in FIG. 3, a handle 10 is disposed at the upper middle of the second side panel 4.

Figure 10:
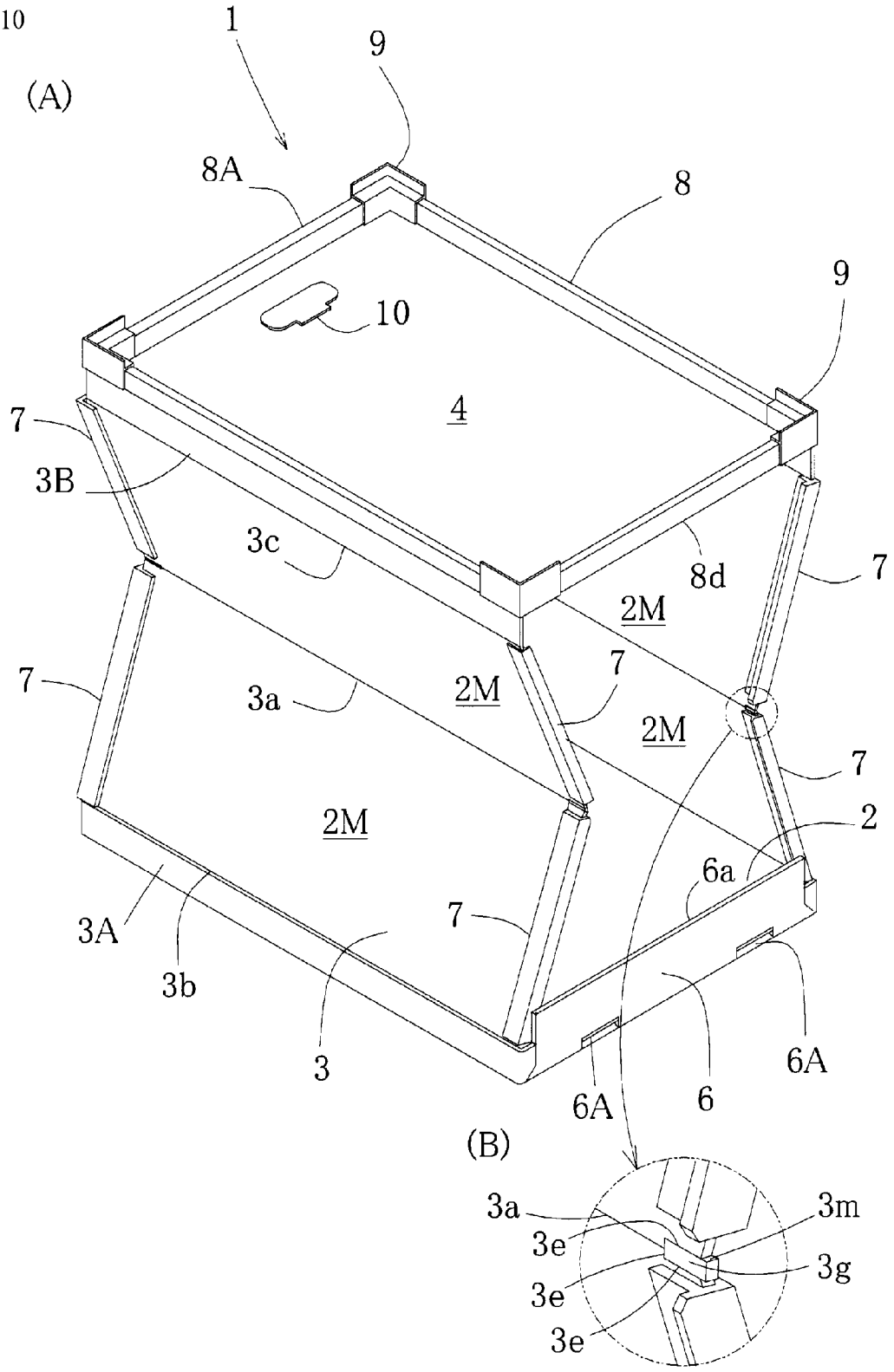
FIG. 10 is an explanatory view of the folded condition in Example 1 of the present invention as viewed from the side face midway during folding of the first side panel incisions inwards, carried out after folding the second side panel incision side faces inwards, then lifting the second side panels upwards, and then folding the second side panels towards the upper short side panels and retaining the panels.
Figure 11:
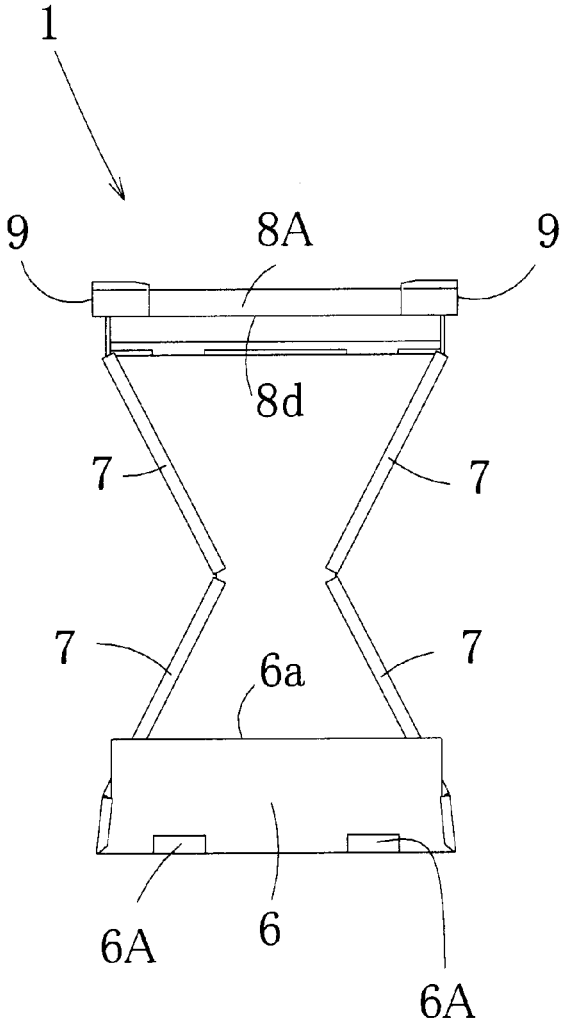
FIG. 11 is a right side view showing a condition in which the left and right middle side panels in Example 1 of the present invention are superimposed and retained in the latch side panels whose heights have been increased.

The folding container that is constituted in this manner is assembled as shown in FIGS. 3 and 10.

A first incision 3*a* is provided, producing two equal divisions, in the middle side panels 3M at heights H1 obtained by subtracting the height i of the upper short side panel 3B and the height h of the lower short side panel 3A of the first side panel 3. In addition, the height of the latch side panel 6 connecting the floor panel 2 is made higher than the lower short side panel 3A, so that a gap X is provided at the inner floor face of the floor panel after one of the folding side panels 2M, 2M of the first side panel 3 is folded to the inner floor face of the floor panel 2, and the other folding side panel 2M, 2M is folded and retained.

It is preferable to ensure a gap X of at least approximately 20 mm. If the gap X is from 0 mm to less than about 20 mm, then folding of the folding side panels 2M will be difficult to carry out smoothly.

The relationship between the height L of the short side face of the floor panel 2 and the maximum dimension of the height H of the first side panel 3 is such that $H=2\times(L-X)+(i+h)$. The height H can be set within a range that satisfies this condition. For this reason, a folding container can be formed that has is extremely tall.

The height H of the first side panel 3 is equivalent to the total of the height h of the lower short side panel 3A, the height i of the upper short side panel 3B, and the height H1 of the middle side panel 3M, and so $H-(i+h)=H1$.

Because the frames 8 are carried on the end faces of the upper short side panels 3B, the height i of the upper short side panels 3B is higher than the height h of the lower short side panels 3A. There are also cases where $i>h$ or $i=h$, based on the relationship in which the second side panel 4 is retained in the upper short side panel 3B.

From the configuration described above, the folding side panels 2M, 2M can be folded up and retained from an inward direction to the left and right, improving the operability during folding by eliminating the folding sequence. Folding and assembly thus can be readily carried out, and the long folding container can be folded into a flat shape having a low profile.

Next, the method for folding the folding container in Example 1 will be described.

First, with the folding container 1 that has been assembled as shown in FIG. 3, engagement of the engaging holes 6A and the engaging pieces 4B is released. In order to retain the second side panels 4 upwards in the folding container, the fourth incision 4*a* of a second side panel 4 is folded inwards, and the panel is lifted upwards. The incision 4*a* of the other second side panel 4 is then lifted inwards and upwards, and the other second side panel 4 is overlapped on the first second side panel 4, thereby retaining the panels within the upper short side panel 3B in the upper part of the box.

Next, with the middle side panel 3M of the first side panel 3, the first incision 3*a* is allowed to fold to the center, and the second incision 3*b* and third incision 3*c* are allowed to fold outwards, thereby folding the panels on the interior of the box like a folding screen (FIGS. 10 to 13).

The folded middle side panel 3M overlaps, in the inward direction, at the middle of the middle side panel 3M, and the respective middle side panels 3M are disposed with the first side panels 3 folded in the first internal space bounded by the floor panel, the respective lower short side panels 3A, and the respective latch side panels 6.

When the folding container 1 that has been formed in the manner described above is in its folded state, the upper end part of the latch side panel 6 abuts the lower end part of the frame 8A and the outer piece 8*c*, and thus the folded state can be continually and uniformly maintained, even when assembly and folding are repeated.

In addition, because load can be distributed by the broad frame 8A at the upper end parts of the latch side panels 6, a folding container 1 can be produced that has excellent durability and load resistance, even in a folded state.

Next, the method for assembling the folding container of Example 1 will be described.

Figure 12:
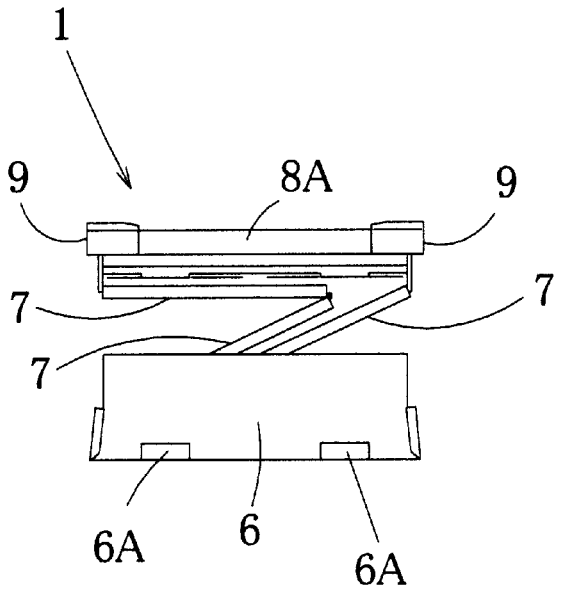
FIG. 12 shows the folding container of Example 1 of the present invention, where
Figure 12:
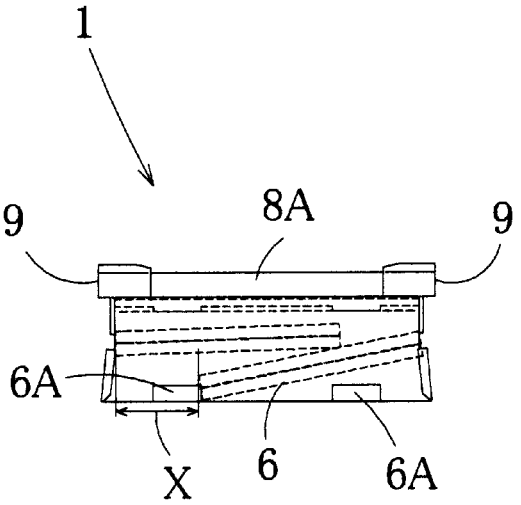

In the folded state shown in FIG. 12(*b*), when the upper part of the folded container is lifted upwards, the first side panels 3 that have been folded inwards from the first incisions 3*a* are set upright as shown in FIG. 12(*a*).

Figure 13:
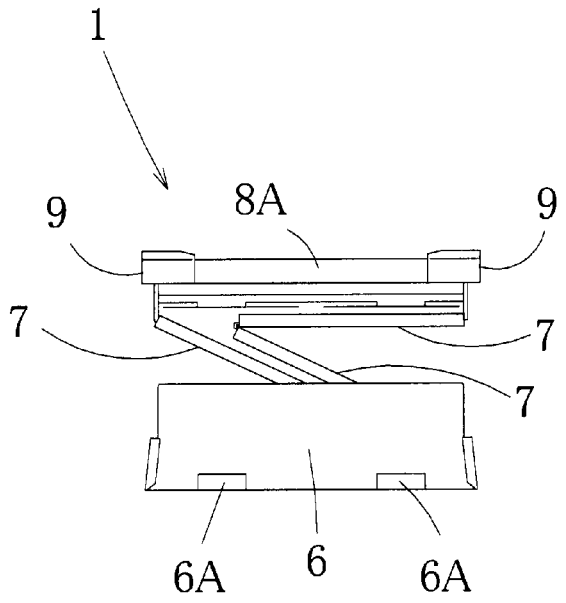
FIG. 13 shows the folding container of Example 1 of the present invention, where
Figure 13:
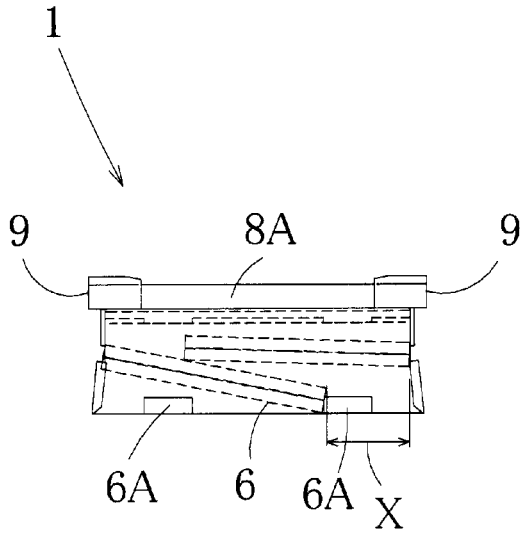
Figure 14:
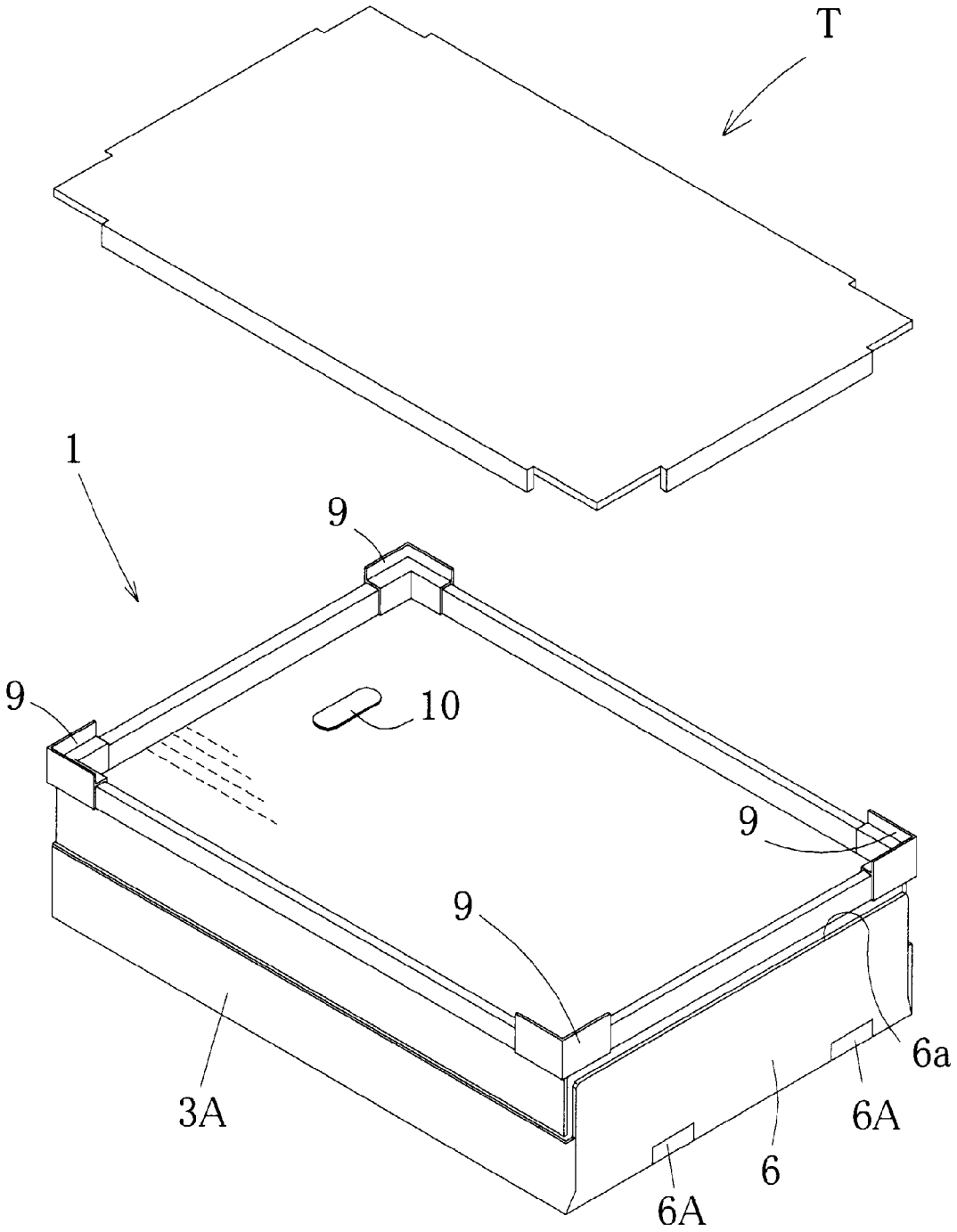
FIG. 14 is an enlarged perspective view showing the box and lid in a state in which the folding container of Example 1 of the present invention has been folded-up.

In addition, if superposition of the middle side panels 3M is reversed, as shown in FIG. 13(*b*), when the upper part of the folded container is lifted upwards in the folded state, the first side panels 3 that have been folded inwards are set upright from the first incisions 3*a* as shown in FIG. 13(*a*).

With the first side panels 3 having been set vertically upright, the incisions 4*a* of the two second side panels 4 that have been folded into the upper part of the folding container are folded outwards and pushed downwards, pressing the second side panels 4 in the outward direction in the folding container 1. The end face parts of the second side panels 4 thus are carried past the stoppers 7*e* of the column members 7 and are made to abut the abutting pieces 7*d*. Because the engaging pieces 4B in the second side panels 4 are thereby made to engage with the engaging holes 6A of the latch side panels 6, the folding container 1 is thereby assembled.

In the condition described above, the two ends of the second side panels 4 and the abutting pieces 7*d* in the column member 7 that are disposed on the first side panels 3 are in an abutting state. The engaging holes 6A of the latch side panels 6 with increased height are engaged with the engaging pieces 4B of the second side panels 4, thus preventing withdrawal of the second side panels 4 in the outward direction from the folded container 1. However, withdrawal of the second side panels 4 can be prevented as a result of additional reinforcement provided by the abutment of the stoppers 7*e* formed in the sandwiching pieces 7*a* of the column member 7 shown in FIGS. 7 and 8 with the two end parts of the second side panels 4.

EXAMPLE 2

Figure 16:
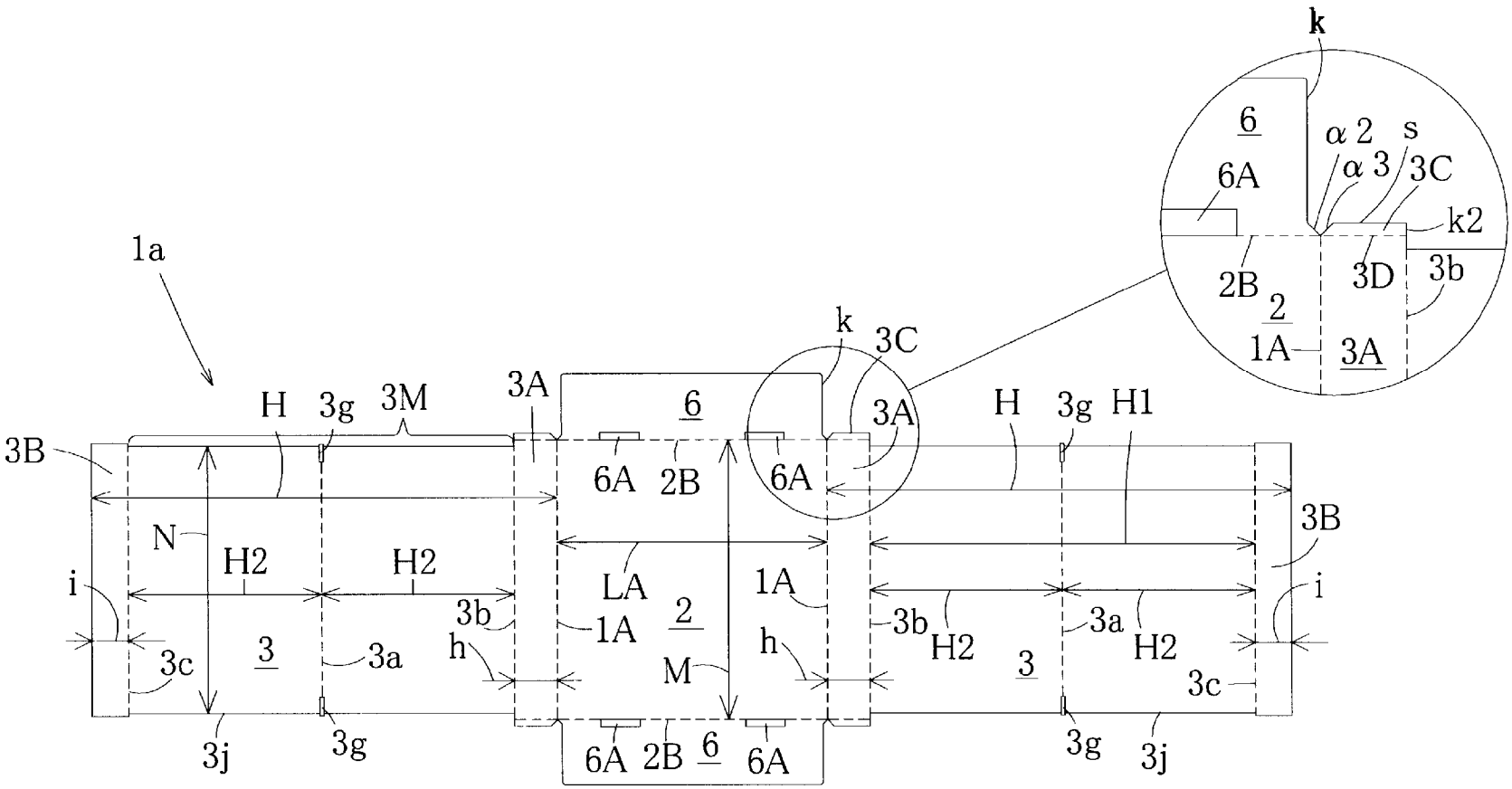
FIG. 16 is a plan-layout diagram of the folding container main body of Example 2 of the present invention in which the floor panel shape is different from that of Example 1 by virtue of being rectangular.
Figure 17:
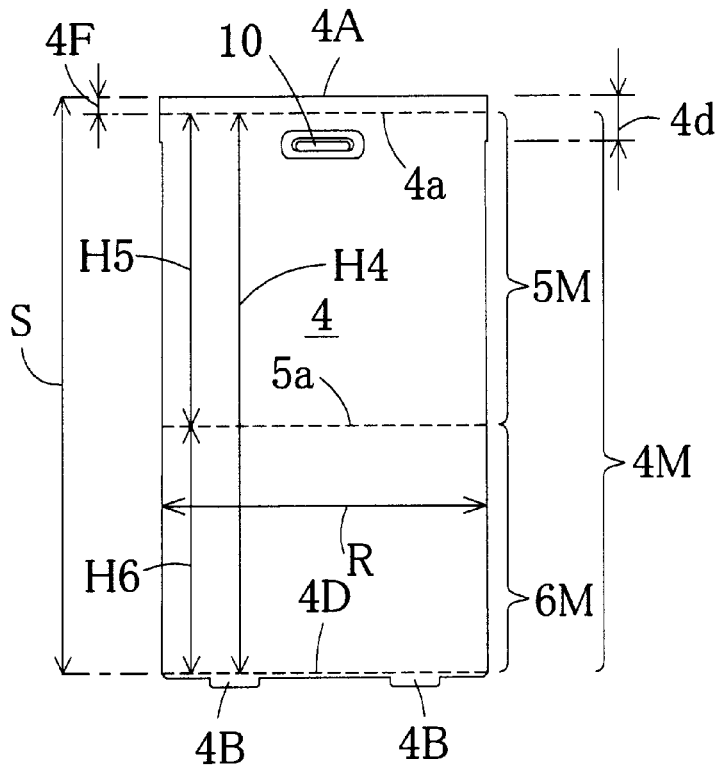
FIG. 17 is a front view of a second side panel of the folding container of Example 2 of the present invention.
Figure 18:
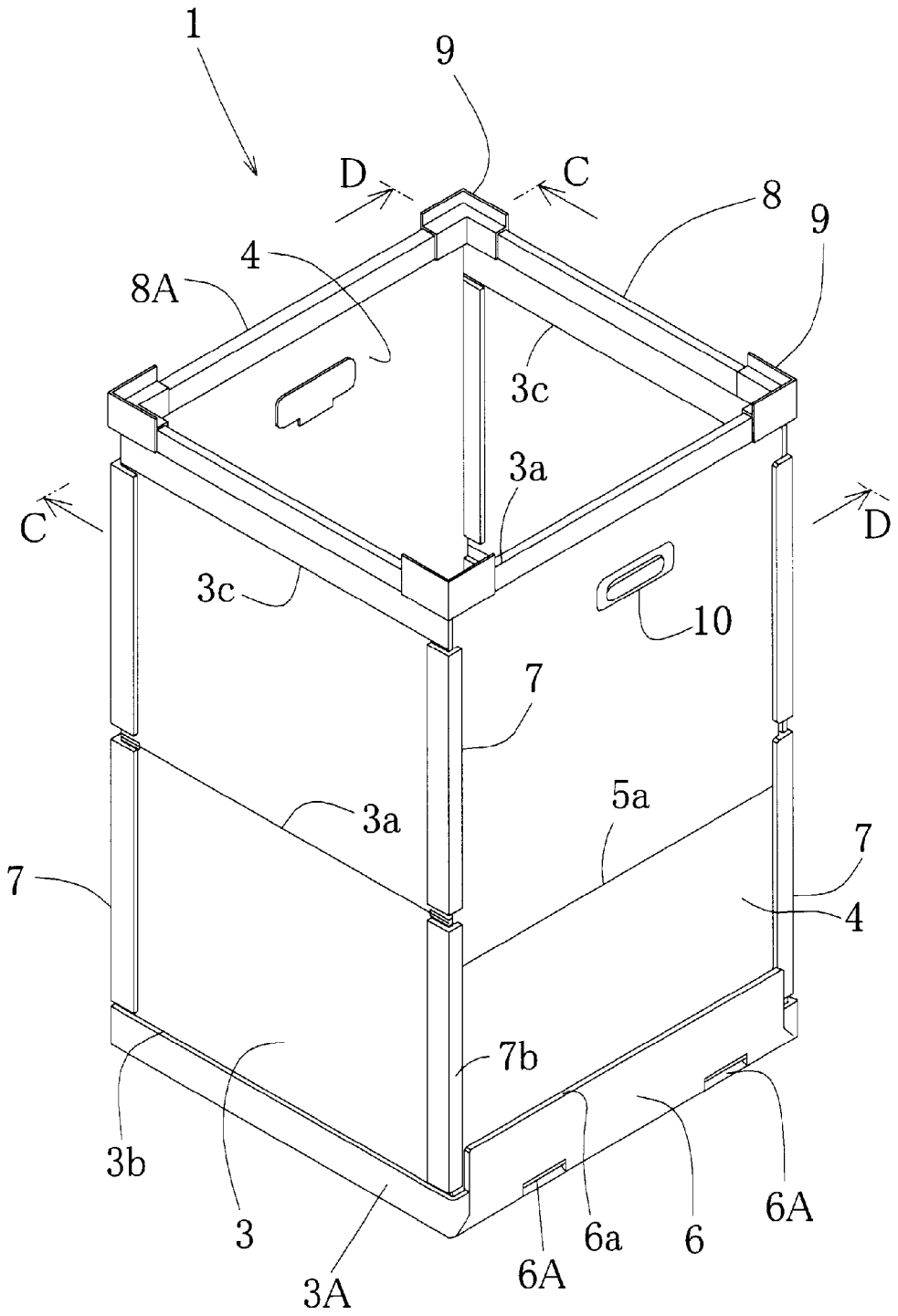
FIG. 18 is a perspective view showing the assembled state of the folding container of Example 2 of the present invention.

FIG. 16 shows the folding container main body 1*a* constituting the folding container of Example 2 of the present invention, and FIG. 17 shows the second panels 4. FIG. 18 presents a total view of the folding container of Example 2.

The corrugated plastic folding container of Example 2 of the present invention shares the basic configuration of Example 1. However, in Example 2, the dimensions in the frontward and rearward directions are greater than the height directions, and so the configuration of Example 1 in which the respective side panels are made from a single sheet of synthetic plastic panel cannot be produced. As a result, fifth incisions 5*a* are provided in the second side panels, producing a folding structure in the second side panels as well as in the first side panels 3. Descriptions concerning the configurational aspects that are shared with Example 1 are omitted, and only the parts that are different are described below.

Specifically, with the second side panels 4 of the folding container 1 pertaining to Example 2, upper pieces 4A are provided via fourth incisions 4*a* in the upper part thereof, and folding lines 4D are provided in a lower part of the second side panels. The region between the folding line 4D and the fourth incision 4*a* is referred to as "folding panel 4M," and a fifth incision is formed at a location that is slightly below the middle of 4M in the vertical direction. As a result of the position in which the fifth incision is formed, the folding panel 4M is divided into two folding side panels with different heights, i.e., a second folding side panel 5M and a third folding side panel 6M. Specifically, the height H5 of the second folding side panel 5M that is above the fifth incision is formed so as to be greater than the height H6 of the third folding side panel 6M below.

With the second folding side panel 5M and the third folding side panel 6M in the folded state, the panels are set so that a gap X is maintained between the opposing side faces (second side panels 4). The gap X is set to be about 20 to 30 mm in Example 2.

In addition, with the second side panels 4 in Example 2, as with the second side panels 4 in Example 1 described above, protruding end parts with a height 4*d* are provided at both upper ends, and a configuration is produced in which engaging pieces 4B protrude at two locations on the lower ends of the second side panels 4. The distance from the folding line 4D to the upper end of the upper part piece 4A is the height S of the second side panel 4.

In addition, the second side panels 4 are made so that the engaging pieces 4B, 4B do not interfere with the frames 8, 8A, the upper corner members 9, or the like when folding the panels.

As a result of the configuration described above, when the folding container 1 is to be folded, a condition can be realized in which the second side panels are folded up by folding and moving upwards the second folding side panel 5M and third folding side panel 6M that constitute the folding panel 4M of one of the second folding panels 4, and then by folding and moving upwards the second folding side panel 5M and third folding side panel 6M that constitute the folding panel 4M of the other of the second folding panels 4.

Subsequently, using the same method as in Example 1, the first side panels 3 can be folded, and folding of the folding container 1 can be completed.

As described above, handles 10 are provided at the upper middle of the second side panels 4 in Example 1, but because the handles 10 are used when lifting up the folded container 1, when pulling up the folded second side panels 4, and when pulling down the second side panels 4 during folding, the handles 10 can be provided below, both above and below, or the handles 10 can be left off, depending on the size of the box.

Attachment of the column members 7 to the first side panels 3 is not restricted to fixation carried out by ultrasonic welding as described in the working example above. For example, fixation can be carried out by heat welding, hot-melt adhesive, two-sided adhesive tape, or the like.

In Example 1, as shown in FIG. 5(*a*), incisions are provided in three circumferential directions, leaving the outer face, at the end part of the first incision 3*a*, forming a face panel part 3*g* in which a face panel protrusion part 3*m* is formed at one end towards the end part. However, the face panel part is not restricted to the above configuration in the present invention. For example, as shown in FIG. 5(*b*), incisions can be provided in three surrounding directions, excluding the outside, at the end part of the first incision 3*a* to the fourth incisions, and the excluded outside end can be made to be the face panel part 3*f* that is formed along the same plane as the end face part 3*j* of the first side panel 3. In addition, as shown in FIG. 5(*c*), a configuration may be produced in which incisions are provided between the two end parts of the first incision 3*a* to the fourth incision in four surrounding directions, leaving the outside face, thereby producing a face panel part 3*h* and the like.

By forming face panel parts 3*h*, in particular, the durability of the long first incision 3*a* can be improved.

Figure 19:
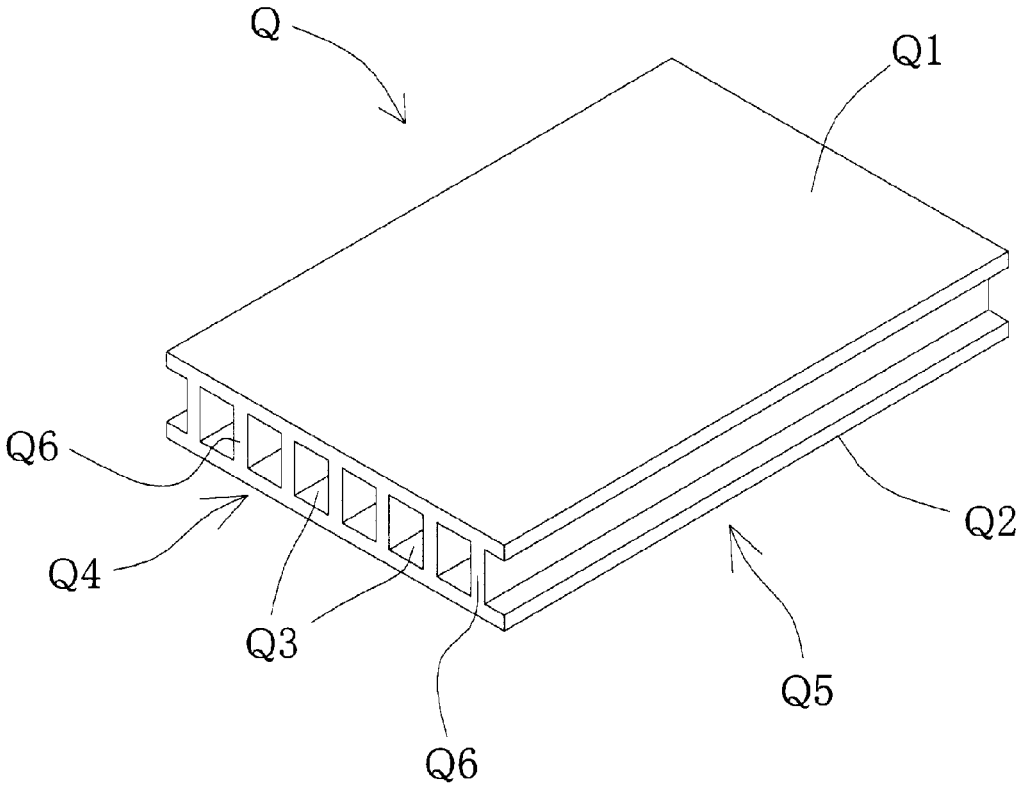
FIG. 19 is an enlarged perspective view of a corrugated plastic sheet having another configuration.

The corrugated plastic pieces P in the present invention are not restricted to corrugated plastic pieces P that have the honeycomb structure shown in FIG. 15. For example, various types of well-known corrugated plastic pieces P can be used, such as a corrugated plastic piece Q in which multiple ribs Q6 are arranged in parallel, perpendicularly between the face panels, as shown in FIG. 19. However, a folding container with more reliable strength can be produced by using a corrugated plastic panel that is hollow and has no directional properties.

Examples of hollow corrugated plastic panels that do not have directional properties include foam board that employs hollow laminated sheets with a three-layer structure (product name "Pla-Pearl", a registered trademark), obtained by heat-fusing two sheets, upper and lower, onto a polypropylene sheet vacuum-molded into cylinder shapes. Additional examples include corrugated plastic that has been integrally molded using polypropylene resin as a starting material, for example, corrugated plastic having a configuration comprising plastic sheet with a four-layer structure that is produced by welding together the pin tips of two polypropylene plastic sheets in which convexities with truncated cone shapes are disposed in a houndstooth pattern (commonly called "core cone") (*3), then bonding the face panels to the surface (TWIN CONE®)?.

The plastic corrugated panel Q has parallel face panels that are the inside face Q1 and the outside face Q2, with the ribs Q6 provided at prescribed intervals in the gap between the face panels. In addition, penetrating holes Q3 are formed in the gaps between the ribs Q6. The ribs Q6 are hollow extruded structural bodies that are constituted by passage holes Q3 in the gaps of the inner face Q1 and the outer face Q2, and a plurality of the ribs Q6 is disposed so as to orthogonally intersect the inside face Q1 and the outside face Q2, forming a shape like a harmonica mouthpiece at the end face Q4, and forming a wall face in the gap between the face panels at the end face Q5 on a side running along a rib Q6.

In addition, the corrugated plastic panel used in the present invention preferably has a resin amount (weight) of 800 g/m$^2$ to 1000 g/m$^2$, and when the resin amount is greater than about 1.2 kg/m$^2$, sufficient strength reliably can be ensured. However, the present invention is not restricted to the resin amounts referred to above, because strength reliability will vary depending on eh properties, etc., of the corrugated plastic panels.

Additionally, in the examples described above, frames 8, 8A represented as cross-sectional views in FIG. 6 were used, but the present invention is not restricted to the frames 8, 8A described in the examples above. The frames may be suitably modified depending on the thickness, etc. of the corrugated plastic. In addition, for example, as shown in FIG. 6(*c*), a frame 8B that ensures sufficient width can be used by providing a hollow part 8*e* between the second side panel outer piece 8*c* and inner piece 8*a*, thus making a cover panel (spacer) unnecessary.

KEY

1: folding container (box body)
1*a*: folding container main body
1A: folding line
2: floor panel
2B: folding line
2M: folding side panel
3: first side panel
3A: lower short side panel
3B: upper short side panel
3C: bending piece
3D: folding line
3M: middle side panel
3*a*: first incision
3*b*: second incision
3*c*: third incision
3*e*: incision
3*f*: face panel part
3*g*: face panel part
3*h*: face panel part
3*j*: end face part
3*k*: protruding end part
3*m*: face panel protrusion part
4: second side panel
4*a*: fourth incision
4A: upper part piece
4B: engaging piece
4D: folding line
4F: upper part piece height
4*d*: protruding end part height
4*f*: cover panel
4M: folding panel
5M: second folding side panel
5*a*: fifth incision
6: latch side panel
6*a*: latch side panel upper end face
6A: engaging hole
6M: third folding side panel
7: column member
7*a*: sandwiching piece
7*b*: linking? Piece
7*c*: gap
7*d*: abutting piece
7*e*: stopper
8: frame (of upper end part in first side panel)
8A: frame (of upper end part in second side panel)
8B: frame (of upper end part having a hollow part in second side panel)
8*a*: inner piece
8*b*: upper end piece
8*c*: outer piece
8*d*: fame lower end face
8*e*: hollow part
9: upper corner member
9*a*: inner piece
9*b*: upper piece
9*c*: outer piece
10: handle
B: rivet
B1: ultrasonic weld part H: first side panel height
H1: middle side panel height
H2: folding side panel height
H4: height of second side panel H
H5: height of second folding side panel of second side panel (5M)
H6: height of third folding side panel of second side panel (6M)
h: height of lower short side panel
i: height of upper short side panel
k: second vertical face
k2: first horizontal face
L: width of floor panel
M: center length of second side panel
N: center length of first side panel
R: width of second side panel
S first vertical face
s first vertical face
α2: second inclined face
α3: first inclined face
T: lid
P: plastic corrugated piece
P1: inside face
P2: outside face
P3: core
Q: plastic corrugated piece
Q1: inside face
Q2: outside face
Q3: penetrating hole
Q4, Q5: end face
Q6: rib
X: gap

The invention claimed is:

1. A long folding container made from corrugated plastic having a folding structure in which a first side panel is provided opposite to the left and right edges of a floor panel, a latch side panel is provided opposite to the front and back edges of the floor panel, a first incision is provided in the left and right first side panels at the same height, a third incision is provided in an upper part of each first side panel, a second incision is provided in a lower part of each first side panel, a column member is provided at both lateral end parts of each first side panel, opposing second side panels are provided at the front and rear edges of the floor panel, frames are attached to upper end parts of each first side panel and second side panel, and, for each opposing first side panel, the first incision folds in, and the second incision and third incision fold out, said long folding container made from corrugated plastic wherein:

the height dimension of the first side panel is larger than the short edge dimension of the floor panel;

with each first side panel, above the third incision serves as an upper short side panel, below the third incision and above the second incision serves as a middle panel, and below the second incision serves as a lower short side panel;

the opposing first incisions, second incisions, and third incisions are made to have the same respective heights;

the internal space of the folding container comprises a first internal space that is circumscribed by the floor panel, the lower short side panel, and the respective latch side panels;

a gap is provided between the first side panel and the short side panel opposing same in the folded state;

additionally, each middle side panel, when in a folded state, can be stored in an inner space containing the first inner space; and in the folded structure, both the left and right middle side panels can fold while being superimposed on each other when brought upwards;

wherein taking the height dimension of the middle side panel in each first side panel as H1, taking the height dimension of each folding side panel configured so that the middle side panels can fold up as H2, taking the left and right width dimensions of the floor panel as L, and taking the gap dimension between the first side panel and the opposing short side panel in the folded state as X, then, for both the left and right middle side panels, the maximum value of H1 is $2\times(L-X)$, and $20\ mm \leq X < H2$.

2. The corrugated plastic long folding container according to claim 1, wherein the height of the latch side panel is greater than the height of the lower short side panel.

3. The corrugated plastic long folding container according to claim 1, wherein the internal space of the folding container in a folded state contains a second internal space that is bounded by each upper short side panel and each latch side panel.

4. The corrugated plastic long folding container according to claim 1, wherein a face panel part is formed on both end parts of the first incision of the first side panel by making incisions encompassing three peripheral sides, leaving the outer face.

5. The corrugated plastic long folding container according to claim 4, wherein each column member is attached to an end face part of the first side panel at a location that is not near the face panel part, and the face panel protrusion part is extended so as to protrude from the end face part of the face panel part.

6. The corrugated plastic long folding container according to claim 1, wherein a folding part that protrudes from an end face part is provided in the lower short side panel, a first inclined face is formed at a location on the bending piece that will be towards the floor panel, an end face that connects with the first inclined face is used as a first vertical face, with both ends of the latch side panel, a second vertical face is formed, the width of the latch side panel decreased by the width of the bending pieces, and a second inclined face is formed in the lower end of the second vertical face, the upright structure of the lower short side panels and latch side panels with respect to the floor panel is a structure that is fixed by welding and does not involve half-cuts, and the first inclined surface and second inclined surface, and the first vertical surface and second vertical surface, are fixed to each other by welding.

* * * * *